US009225124B2

(12) United States Patent
Ando et al.

(10) Patent No.: US 9,225,124 B2
(45) Date of Patent: Dec. 29, 2015

(54) CONNECTOR WITH ELECTRONIC COMPONENT AND HOLDER

(71) Applicant: Sumitomo Wiring Systems, Ltd., Yokkaichi, Mie (JP)

(72) Inventors: Motohiro Ando, Yokkaichi (JP); Tomoyuki Kondo, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 39 days.

(21) Appl. No.: 14/172,148

(22) Filed: Feb. 4, 2014

(65) Prior Publication Data

US 2014/0220823 A1 Aug. 7, 2014

(30) Foreign Application Priority Data

Feb. 5, 2013 (JP) ..... 2013-020113
Jun. 5, 2013 (JP) ..... 2013-118612

(51) Int. Cl.
*H01R 13/66* (2006.01)
*H01R 13/405* (2006.01)

(52) U.S. Cl.
CPC ..... *H01R 13/6625* (2013.01); *H01R 13/66* (2013.01); *H01R 13/405* (2013.01); *H01R 2201/26* (2013.01)

(58) Field of Classification Search
CPC ..... H01R 13/6625; H01R 2201/26; H01R 13/405
USPC ..... 439/620.21, 620.1, 620.01, 609.09, 439/620.2, 694, 620.13, 490
See application file for complete search history.

(56) References Cited

U.S. PATENT DOCUMENTS

| | | | | |
|---|---|---|---|---|
| 7,563,127 | B2 * | 7/2009 | Kurahashi | 439/474 |
| 7,677,916 | B2 * | 3/2010 | Chang | 439/490 |
| 7,823,280 | B2 * | 11/2010 | Chung et al. | 29/856 |
| 7,833,061 | B2 * | 11/2010 | Hori et al. | 439/620.21 |
| 8,550,851 | B2 * | 10/2013 | Takemoto | 439/620.21 |
| 2012/0129392 | A1 | 5/2012 | Fujisaki | |

FOREIGN PATENT DOCUMENTS

| | | |
|---|---|---|
| JP | 2007-287644 | 11/2007 |
| JP | 2012-109158 | 6/2012 |

* cited by examiner

*Primary Examiner* — Abdullah Riyami
*Assistant Examiner* — Harshad Patel
(74) *Attorney, Agent, or Firm* — Gerald E. Hespos; Michael J. Porco; Matthew T. Hespos

(57) ABSTRACT

A connector includes an electronic component (60), a holder (20) for holding the electronic component (60), a housing (10) including an insertion opening (11), into which the holder (20) is insertable and which is open only in one direction, and configured to accommodate the holder (20) holding the electronic component (60), and conductive members (40) for conductively connecting the electronic component (60) and mating terminal fittings. The conductive members (40) include holder press-fit portions (51, 53) to be press-fitted into the holder (20) and housing press-fit portions (55) to be press-fitted into the housing (10) and the holder (20) is held in the housing (10) by the conductive members (40).

10 Claims, 13 Drawing Sheets

CONNECTOR WITH ELECTRONIC COMPONENT AND HOLDER

BACKGROUND

1. Field of the Invention

The invention relates to a connector with an electronic component and a holder.

2. Description of the Related Art

Japanese Unexamined Patent Publication No. 2007-287644 discloses a connector with a capacitor built in to an electronic component. However, a potting agent or similar treatment must be filled around the electronic component to waterproof the connector. Filling the potting agent is inefficient and costly. Therefore, a method for waterproofing by using a bag-shaped housing to accommodate an electronic component in this housing is considered. However, the electronic component must be mounted in a holder before being mounting in the bag-shaped housing and the holder must be accommodated in the housing. Therefore a locking structure is needed for the holder and the housing. The housing must have a projection or a hole to form the locking structure. A punched hole is necessary to form a projection. Further, a hole is not suitable for waterproofing since water enters through the hole. Japanese Unexamined Patent Publication No. 2012-109158 discloses a waterproof connector that is open in only one direction and includes a rear holder for fixing a holder and a bag-shaped housing.

The waterproof connector disclosed in Japanese Unexamined Patent Publication No. 2012-109158 requires the rear holder to hold the holder and the housing. Thus, the number of components increases and the overall structure is complicated.

The invention was completed in view of the above situation and aims to simplify a structure of a connector with an electronic component.

SUMMARY OF THE INVENTION

The invention relates to a connector with at least one electronic component; a holder for holding the electronic component and a housing with an insertion opening for receiving the holder. The opening opens in only one direction, and is configured to accommodate the holder that holds the electronic component. At least one conductive member conductively connects the electronic component and a mating terminal fitting of a mating connector. The conductive member includes at least one holder press-fit portion to be press-fit into the holder and a housing press-fit portion to be press-fit into the housing. The holder is held in the housing by the conductive member.

The holder press-fit portion on the conductive member is press-fit into the holder that holds the electronic component. The housing opens in only one direction and the holder into which the conductive member is press-fit is inserted into the housing. The housing press-fit portion of the conductive member is press-fit into the housing when the holder is accommodated at a specified position in the housing. The conductive member holds the holder and the housing by being press-fit. Thus, the holder is held in the housing via the conductive member. Therefore it is not necessary to use another component and the number of components can be reduced. Further, there is no need for a hole or a projection. Hence, there is no need for a structure for sealing the hole or the like in the housing and the interior of the housing is fluid- or waterproofed easily.

The conductive member may include two of the housing press-fit portions that project laterally from outer side surfaces of the holder. Thus, a holding force can be improved since the conductive member is fixed to the housing at two points. Further, the laterally projecting housing press-fit portions can receive the forces when the holder and the conductive member are inserted into the housing and avoid the need to apply an unnecessary force to the holder. The holder generally is made of resin, and a press-fit force applied to the holder could form cracks at a position where the force is applied. However, the conductive member generally is made of metal and can receive the press-fit force without cracking. Thus, the resin of the holder is not likely to crack.

The housing may include a thick portion into which the housing press-fit portion is to be press-fitted. A force tends is applied to the position where the housing press-fit portion is press-fit. However, the housing is thickened at the press-fitted position so that breaks, cracks and the like are not likely to form.

The holder press-fit portion may be a projection projecting substantially from a center of the conductive member. The finished sizes of the conductive member and the holder vary within tolerances. However, the influence of displacements caused by such variation ranges on positioning the housing press-fit portion can be reduced.

The conductive member may comprise first and second conductive members that are insertable substantially in parallel into the holder in first and second rows. Each of the first and second conductive members may include terminals to be connected to the mating terminal fittings, a coupling that couples the terminals and an electronic component connecting portion to be welded to the electronic component. The electronic component connecting portion of the first conductive member may include a bent portion and a first connection portion projecting from the holder and to be welded electrically to the electronic component. The electronic component connecting portion of the second conductive member may include a second connection portion on substantially the same plane as the coupling and projecting from the holder for electrical connection to the electronic component. The first and second welding portions may be at the same heights.

The conductive members are inserted into the housing after being held in the holder in advance. Thus, insertion operability into the housing can be improved. Operability is improved further since the holder holds the conductive members and the electronic component at the time of welding. Further, the first conductive member includes the bent portion and the second conductive member maintains its vertical height so that the heights of the electronic component connecting portions are aligned. Therefore, the electronic component connecting portions are connected more easily to the electronic component.

The holder may include an insertion portion into which the first and second conductive members are insertable. The holder press-fit portion of the first conductive member may project from a center or intermediate position of the coupling substantially in parallel to the electronic component connecting portion at a side opposite to the terminal portions and press-fit into a holder press-fit hole formed in a back of the insertion portion.

By adopting such a configuration, the first conductive member including the bent portion is fixed to the holder by press-fitting the separately formed holder press-fit portion from the electronic component connecting portion including the bent portion. Thus, no pressing load is applied in the vicinity of the bent portion. Further, since the holder press-fit portion is present in the center or intermediate position of the coupling portion, the influence of displacements caused by tolerances can be reduced.

The holder may include an insertion portion for receiving the first and second conductive members. A through hole for receiving the bent portion and the first welding portion and an insertion hole for receiving the electronic component connecting portion of the second conductive member may be formed adjacent to each other in a width direction in the holder. A part between the through hole and the insertion hole may be thin, and the electronic component connecting portion of the second conductive member may include the holder press-fit portion to be press-fitted into the insertion hole.

The above-described configuration provides a relatively large through hole to insert the bent portion and the first welding portion of the first conductive member. The part between through hole and the insertion hole and adjacent to the through hole in the width direction receives the electronic component connecting portion of the second conductive member and is thin. Thus, it is difficult to provide a holder press-fit portion shaped like the holder press-fit portion of the first conductive member and to provide a hole in the thin portion between the through hole and the second connecting portion insertion hole for receiving the holder press-fit portion. Accordingly, the holder press-fit portion is provided on the electronic component connecting portion of the second conductive member and is press-fit into the insertion hole. Therefore, the second conductive member can be press-fit and fixed without enlarging the holder. Further, molding is easier since it is not necessary to form a hole in the thin portion.

These and other objects, features and advantages of the invention will become more apparent upon reading the following detailed description of preferred embodiments and accompanying drawings.

DETAILED DESCRIPTION OF THE PREFERRED EMBODIMENTS

Figure 1:
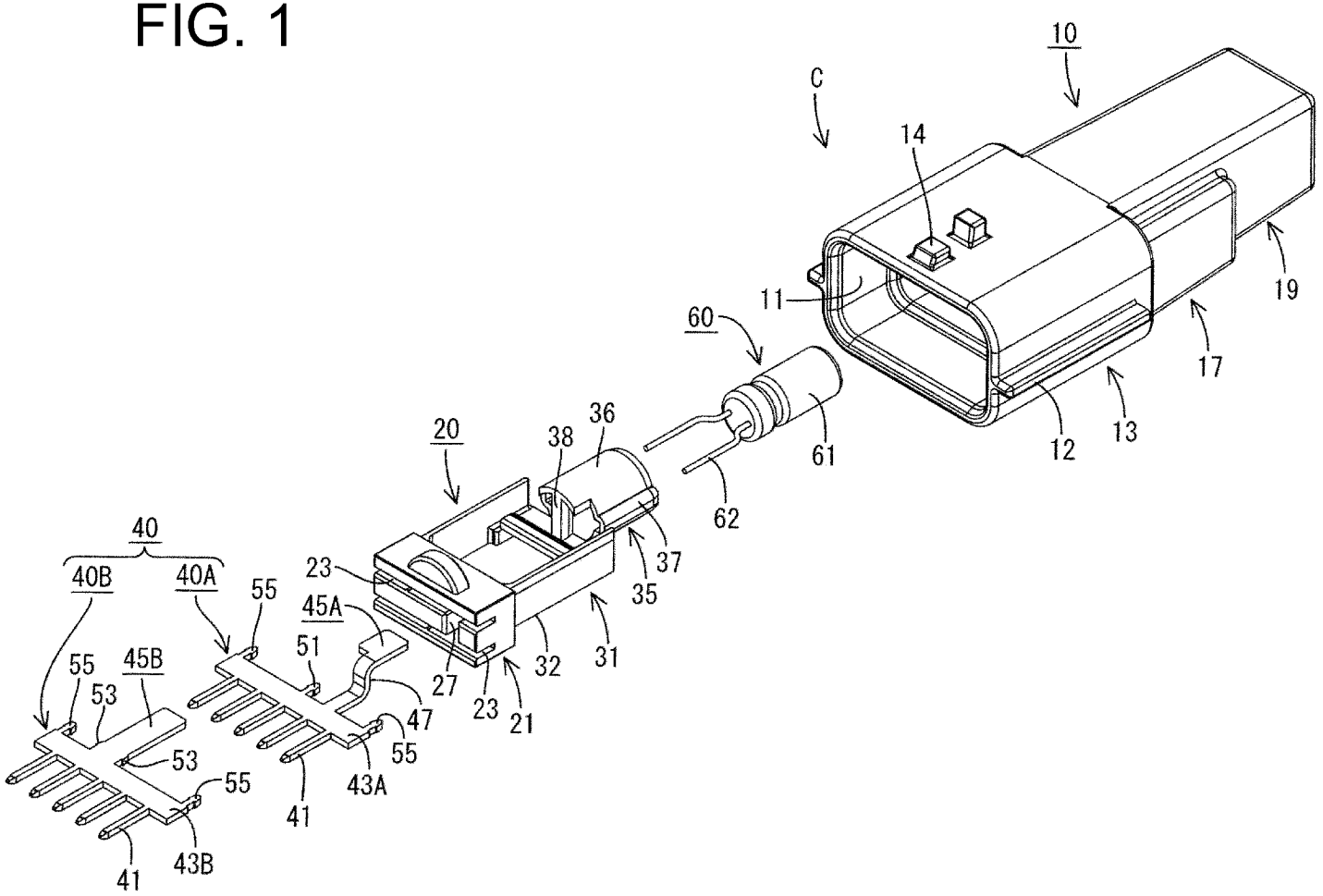
FIG. 1 is an exploded perspective view of a connector with an electronic component according to one embodiment of the present invention.

A connector C with an electronic component is configured for removing noise of electric/electronic devices mounted in an automotive vehicle. The connector C includes a housing 10 that is open in one direction, and a holder 20 to be accommodated in the housing 10. The holder 20 holds positive and negative busbars 40 and a capacitor 60 as an example of an electronic component. The capacitor 60 is interposed or connected between the positive and negative busbars 40. The connector C is a joint connector for collectively connecting unillustrated wires to be drawn out from the electric/electronic devices mounted in an automotive vehicle. In the following description, a connection surface side of each constituent member in the connector C to a mating connector 80 (see FIG. 14) is referred to as a front end, an opposite end is referred to as a rear end, and upper, lower and lateral sides are based on FIG. 2.

The housing 10 is made e.g. of synthetic resin and is substantially in the form of a bag or box that is open only in one direction, as shown in FIG. 1. The opening forms an insertion opening 11 into which the holder 20 is insertable. The housing 10 comprises a receptacle 13 to be fit to the mating connector 80 (see FIG. 14) including mating terminal fittings, a holder accommodating portion 18 for accommodating an intermediate portion 31 of the holder 20, and a capacitor accommodating portion 19 for accommodating the capacitor 60. The receptacle 13, the holder accommodating portion 18 and the capacitor accommodating portion 19 are formed unitarily to define a bag or box having a stepped shape.

The busbar 40 is formed by punching, cutting, stamping, embossing and/or bending a conductive plate material such as metal, as shown in FIG. 1. The busbar 40 includes terminals 41 to be connected to the respective terminal fittings held in the mating connector 80 (see FIG. 14), a strip-like coupling 43 that couples the terminals 41 into a comb teeth shape, and an electronic component connecting portion 45 to be connected to the capacitor 60.

The respective terminals 41 are in the form of tabs and project side by side at constant intervals (pitch) on the front end surface of the strip-like coupling 43. The electronic component connecting portion 45 is formed on the rear surface of the strip-like coupling 43 substantially opposite to the terminals 41 and extends substantially perpendicularly from the strip-like coupling 43.

Figure 10:
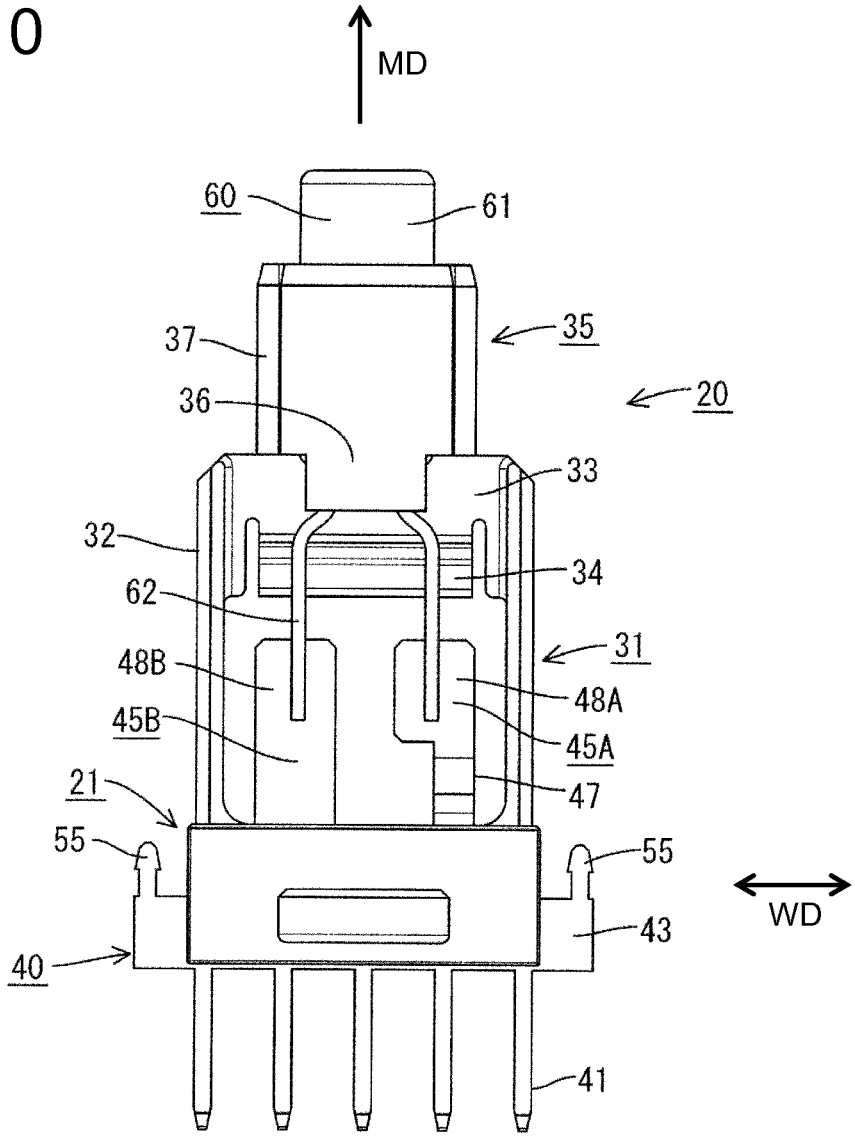
FIG. 10 is a front view showing the state where the busbar pieces and the capacitor are mounted in the holder.
Figure 11:
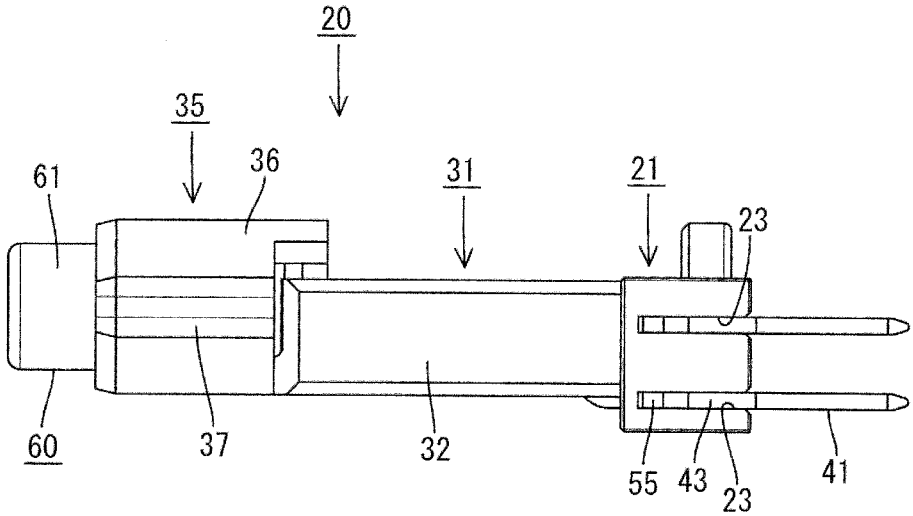
FIG. 11 is a side view showing the state where the busbar pieces and the capacitor are mounted in the holder.
Figure 12:
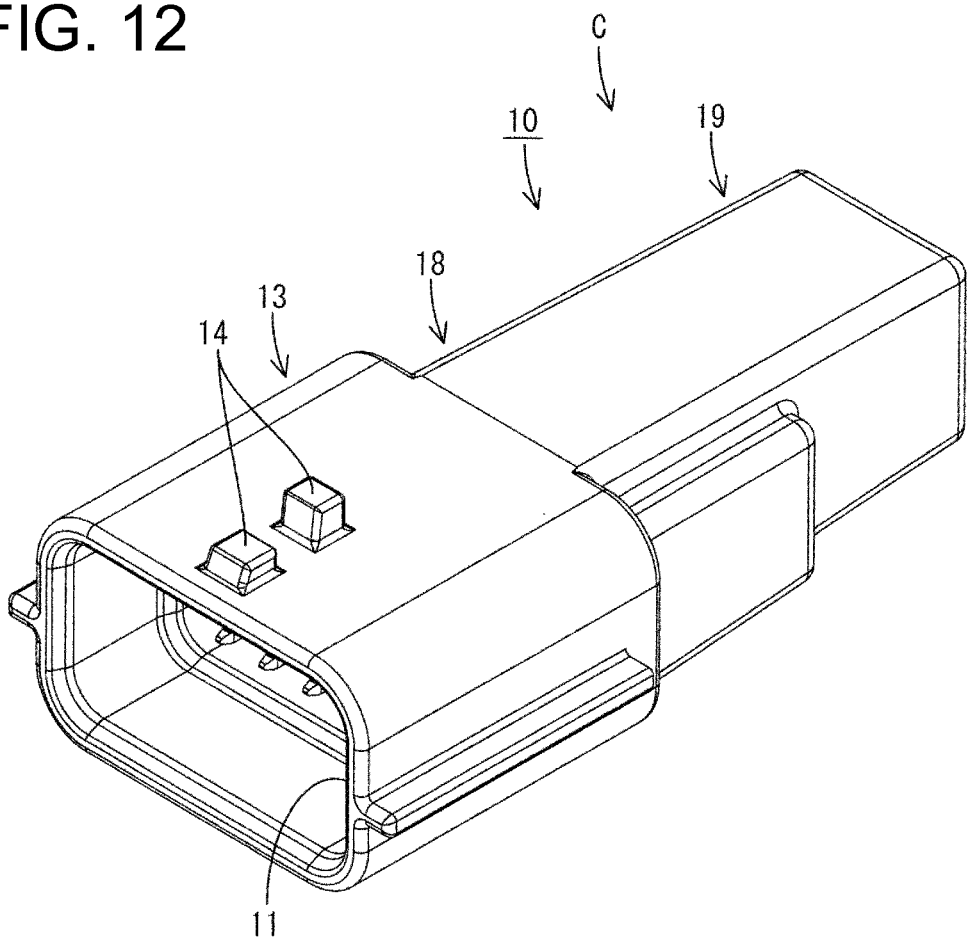
FIG. 12 is a perspective view of the connector with the electronic component.
Figure 13:
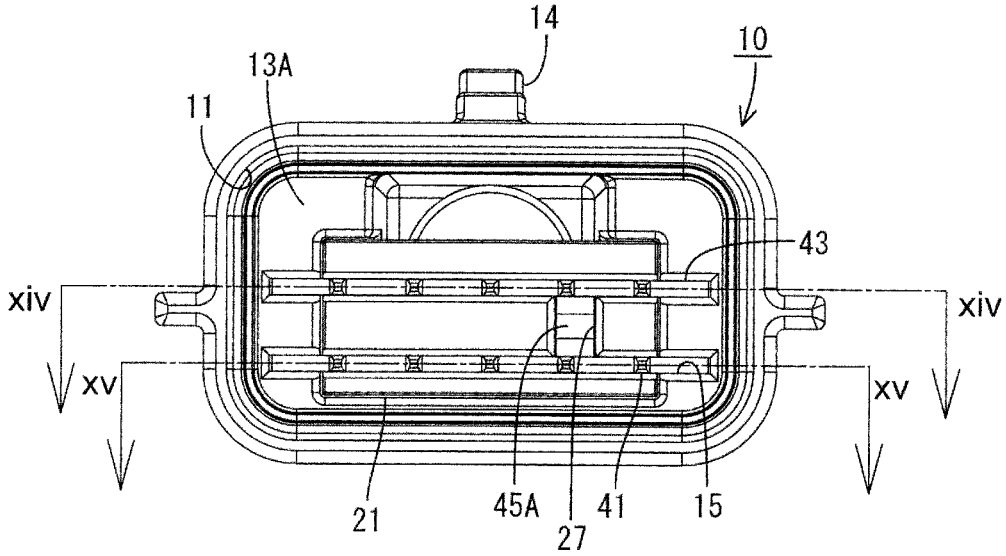
FIG. 13 is a front view of the connector with the electronic component.

As shown in FIG. 10, a width of each strip-like coupling 43 in a width direction WD exceeds a length of a busbar holding portion 21 of the holder 20. Thus, when the busbars 40 are mounted into the holder 20, each strip-like coupling 43 projects from opposite left and right ends of the busbar holding portion 21.

Figure 8:
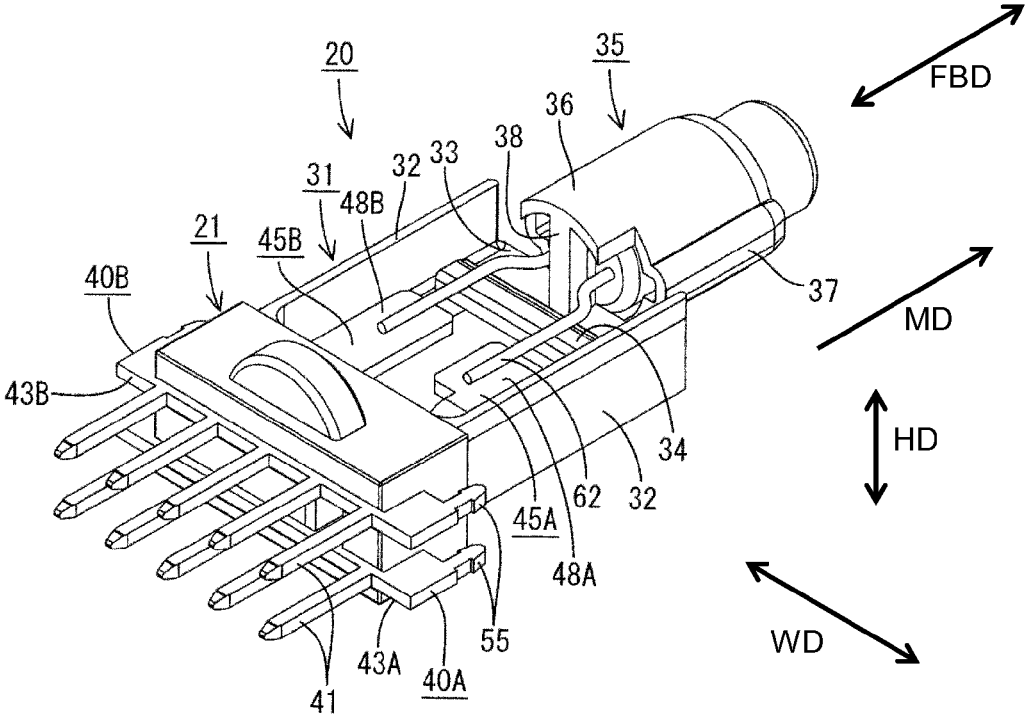
FIG. 8 is a perspective view showing a state where busbar pieces and a capacitor are mounted in the holder.
Figure 9:
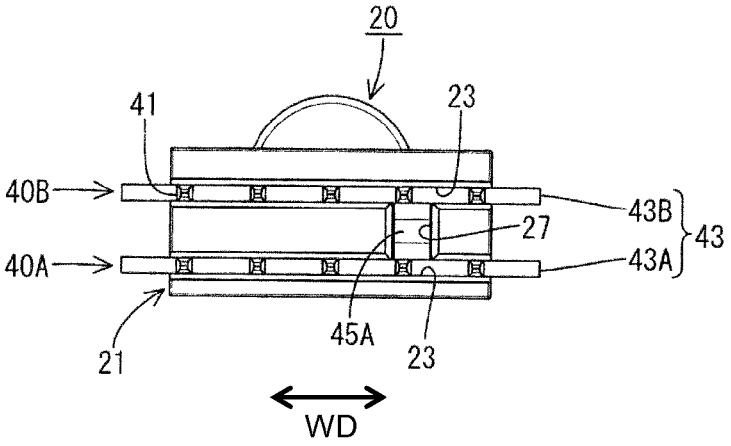
FIG. 9 is a plan view showing the state where the busbar pieces and the capacitor are mounted in the holder.

The positive and negative busbars 40 are arranged in upper and lower rows in a height direction HD of the holder 20, as shown in FIG. 8. Note that the busbar 40 in the lower row is referred to as a first busbar 40A and the one in the upper row is referred to as a second busbar 40B.

Each of the first and second busbars 40A, 40B has five terminals 41 arranged at positions to define pairs of vertically aligned respective terminals 41.

The first busbar 40A has a first electronic component connecting portion 45A and the electronic component connecting portion of the second busbar 40B has a second electronic component connecting portion 45B spaced from the first electronic component connecting portion 45A in the width direction WD of the holder 20 as shown in FIG. 10.

Figure 7:
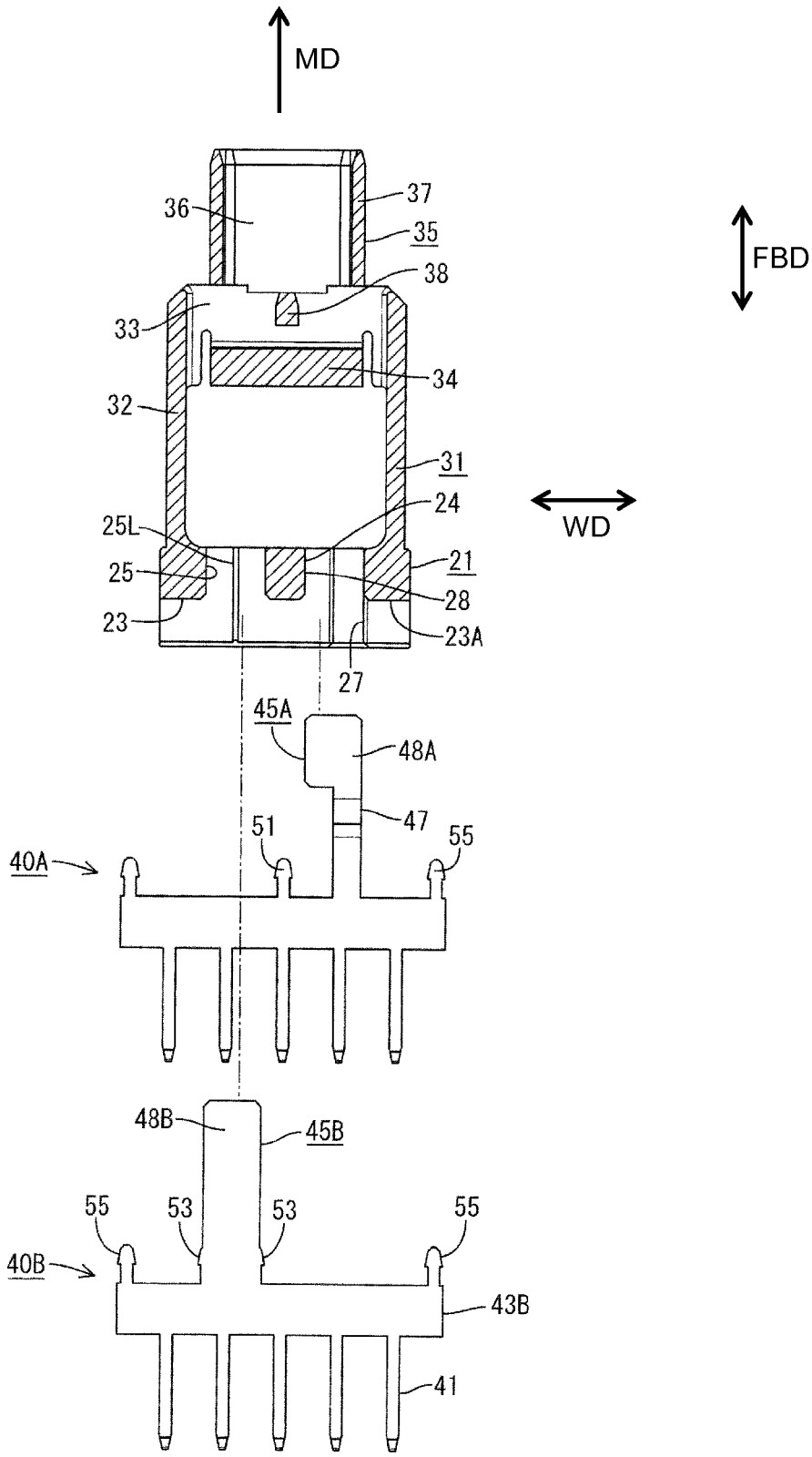
FIG. 7 is a section along vii-vii of FIG. 5 and a view of a busbar piece.

As shown in FIG. 7, the second electronic component connecting portion 45B projects back from a position laterally displaced from a center of the second strip-like coupling 43B in the width direction WD of the holder 20 and that projecting part forms a second connection portion 48B to be connected electrically to a lead wire 62 of the capacitor 60.

The second electronic component connecting portion 45B is substantially flat over the entire length including the second connection portion 48B. There also is no difference in elevation between the second electronic component connecting portion 45B and the second strip-like coupling 43B so that the entire second busbar piece 40B is flat. Note that a width of the second electronic component connecting portion 45B is substantially constant over the entire length except at the second press-fit portions 53.

Figure 14:
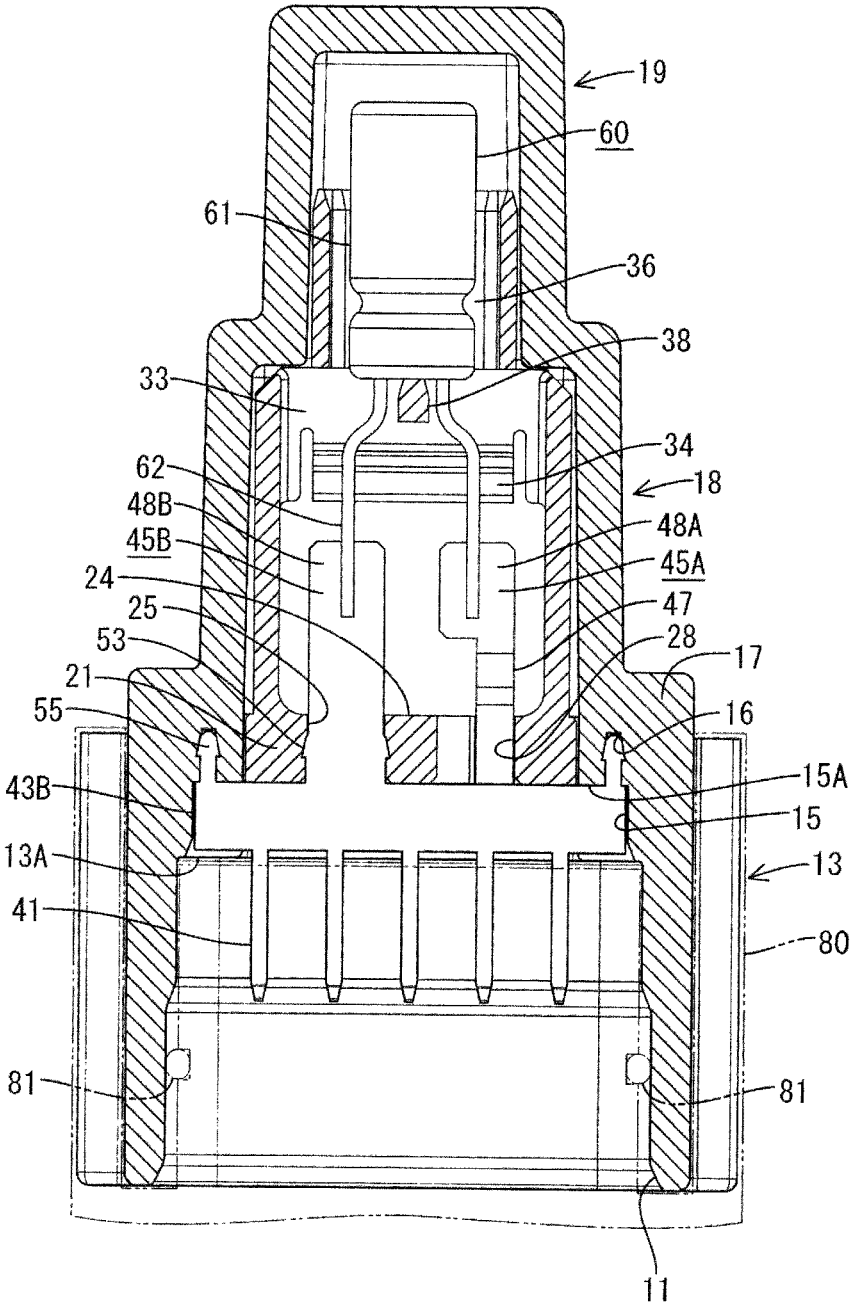
FIG. 14 is a view partly in section along xiv-xiv of FIG. 13.

The second press-fit portions 53 are widened toward the front. As a result, wider parts of the second press-fit portions 53 bite into the resin as the second electronic component connecting portion 45B is press-fit into a second connecting portion insertion hole 25. Specifically, a wedge-shaped press-fit portion is formed by combining two second press-fit portions 53 provided on the left and right sides of the second electronic component connecting portion 45B. As shown in FIG. 14, the second press-fit portions 53 are engaged with a substantially lengthwise central part of the busbar holding portion 21 in a front-back direction FBD, thereby functioning to retain the second busbar piece 40B at a specified position in the holder 20.

As shown in FIG. 1, the first electronic component connecting portion 45A projects back from a position displaced laterally from a center of the first strip-like coupling 43A in the width direction WD and that projecting part forms a first connection portion 48A to be welded to a lead wire 62 of the capacitor 60. The first electronic component connecting portion 45A has a bent portion 47 bent twice at substantially right angles at intermediate positions in the length or front-back direction FBD so that a tip part of the first connection portion 48A is at substantially the same position along the height direction HD as the second electronic component connecting portion 45B. Specifically, after being bent up at an intermediate position in the length direction, the first electronic component connecting portion 45A is bent further backward at a position substantially at the same height as the second electronic component connecting portion 45B to form the bent portion 47. Further, the first connection portion 48A of the first electronic component connecting portion 45A is slightly wider than the bent portion 47.

Figure 15:
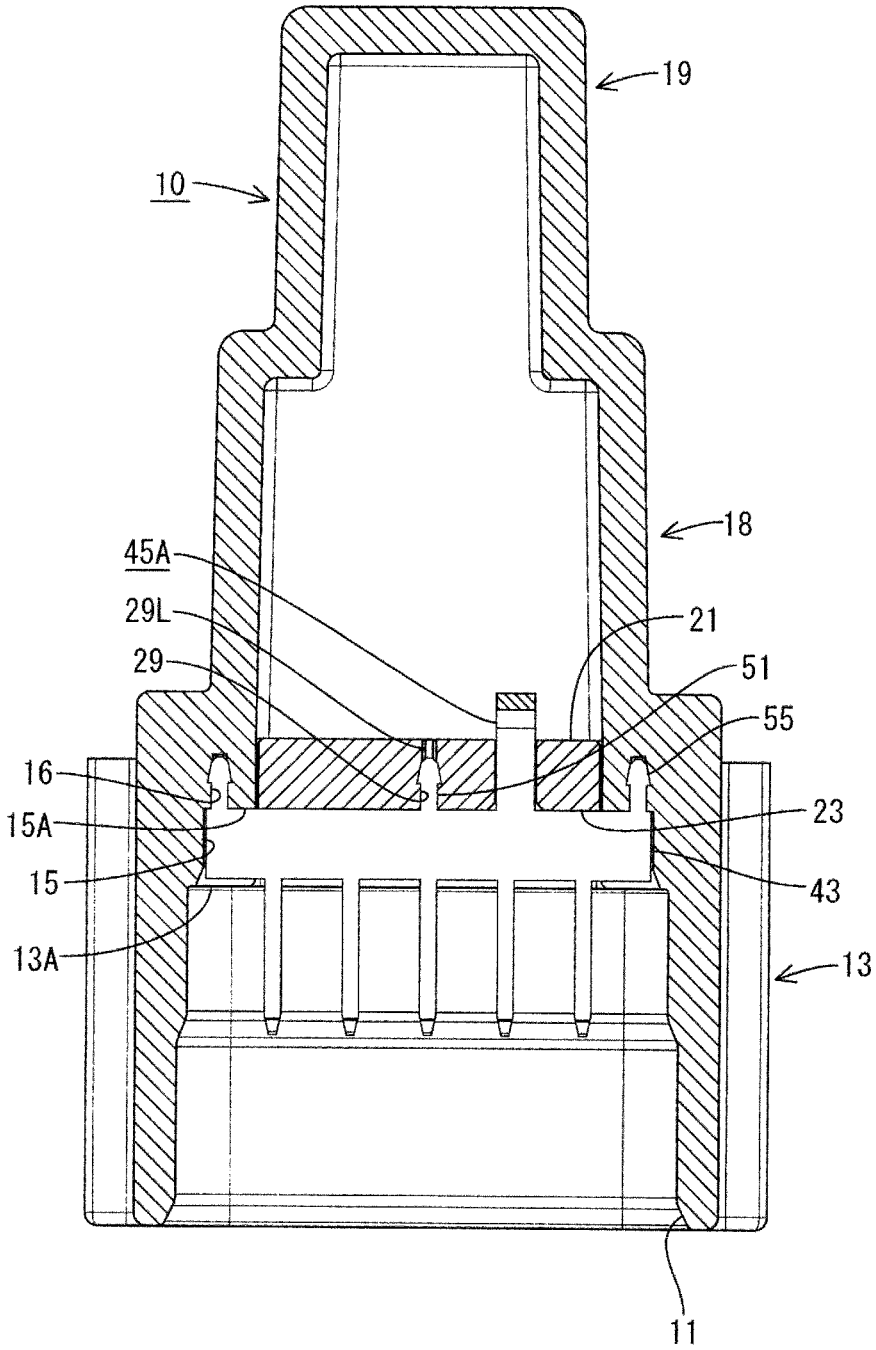
FIG. 15 is a section along xv-xv of FIG. 13.

As shown in FIG. 15, the first busbar 40A includes a first press-fit portion 51 to be press-fit into a holder press-fit hole or recess 29 formed in the holder 20 by being pushed backward in a mounting direction MD relative to the busbar holding portion 21 of the holder 20. The first press-fit portion 51 projects from the same side of the first strip-like coupling 43A as the first electronic component connecting portion 45A, i.e. at a side opposite the terminals 41. The first press-fit portion 51 is shorter than the busbar piece holding portion 21 in the front-back direction FBD and a tip part thereof is wedge-shaped or undercut. By providing the first press-fit portion 51 at a position different from the bent first electronic component connecting portion 45A, a press-fit force is applied to the bent position and deformation can be prevented.

As shown in FIGS. 14 and 15, each busbar 40 has housing press-fit portions 55 to be press-fit into housing press-fit holes 16 in the housing 10 by being pushed back in the mounting direction MD relative to the housing 10. The housing press-fit portions 55 project from the same side of the first strip-like coupling 43A as the first electronic component connecting portion 45A, i.e. the side opposite the terminals 41. Lengths of the housing press-fit portions 55 are substantially equal to the length of the first press-fit portion 51 and tips thereof are wedge-shaped or undercut. Further, each busbar 40 has two housing press-fit portions 55. The housing press-fit portions 55 are on opposite lateral ends of the strip-like coupling 43. The housing press-fit portions 55 project laterally from the busbar piece holding portion 21 when the busbar 40 is mounted into the holder 20.

The capacitor 60 is an aluminum electrolytic capacitor and includes a cylindrical capacitor main body 61, and positive and negative lead wires 62 drawn out from the front end surface of the capacitor main body 61. The lead wires 62 are round pins and project from the front end surface of the capacitor main body 61 substantially in the axial direction of the capacitor main body 61. The lead wires 62 are arranged at a given distance from each other and are arranged above the electronic component connecting portions 45 of the busbar pieces 40 by being mounted, and electrically connected to the electronic component connecting portions 45 by resistance welding.

The holder 20 is made e.g. of synthetic resin and, as shown in FIG. 8, is long and narrow in the front-back direction FBD. The busbar holding portion 21 for holding the busbars 40 is formed on a front end and an electronic component holding portion 35 for holding the capacitor 60 is formed on a rear end. The busbars 40 and the capacitor 60 are connected in the intermediate portion 31 between the busbar holding portion 21 and the electronic component holding portion 35 in the holder 20. The electronic component holding portion 35 is substantially in a center of the holder 20 in the width direction WD.

The electronic component holding portion 35 includes a substantially cylindrical tubular portion 36 for accommodating the capacitor main body 61 inside, ribs 37 for preventing rotation during insertion into the housing 10, and a spacer 38 arranged between the lead wires 62 of the capacitor 60. The tubular portion 36 is formed so that an axial direction extends in the front-back direction FBD and a rear end thereof is open so that the capacitor 60 can be inserted therein from behind. A front end also is open so that the lead wires 62 are insertable. A part of an upper surface of the tubular portion 36 extends forward, and the columnar spacer 38 projects down from this extending part. The spacer portion 38 prevents the mutual contact of the lead wires 62.

Figure 6:
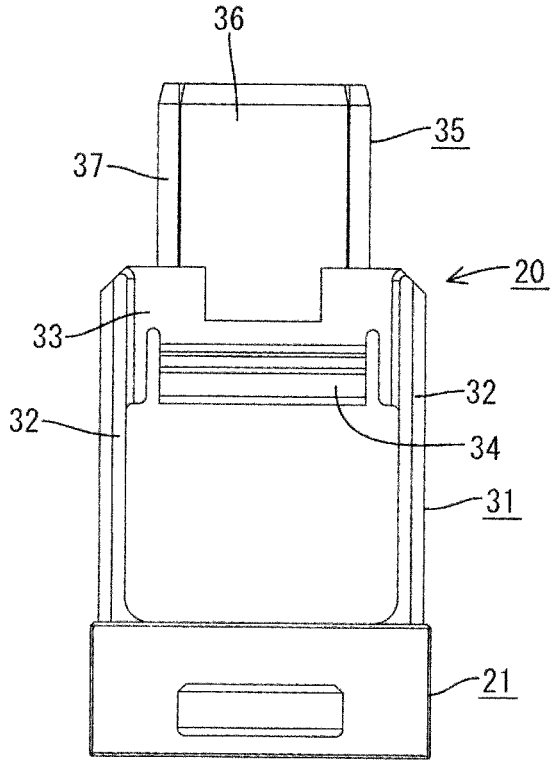
FIG. 6 is a plan view of the holder.

As shown in FIGS. 6 to 8, the intermediate portion 31 includes two side walls 32 that face each other in the width direction WD, an intermediate coupling portion 33 couples the side walls 32, and a lead wire support 34 supports the lead wires 62. The side walls 32 are substantially parallel to each other and the front ends thereof are coupled to the busbar holding portion 21. The intermediate coupling 33 couples rear ends of the side walls 32 and/or coupled to the electronic component holding portion 35 by being molded unitarily to a lower part of the spacer 38. Further, the lead wire support 34 for supporting the lead wires 62 of the capacitor 60 is provided on the front end of the intermediate coupling 33. The lead wire support 34 is cantilevered forward from the intermediate coupling 33 and is vertically resiliently deformable. A space in the intermediate portion 31 surrounded by the two side walls 32, the busbar piece holding 21 and the electronic component holding portion 35 has open upper and lower sides so that the electronic component holding portion 35 can be connected electrically to the lead wires 62, such as by resistance-welding.

Figure 5:
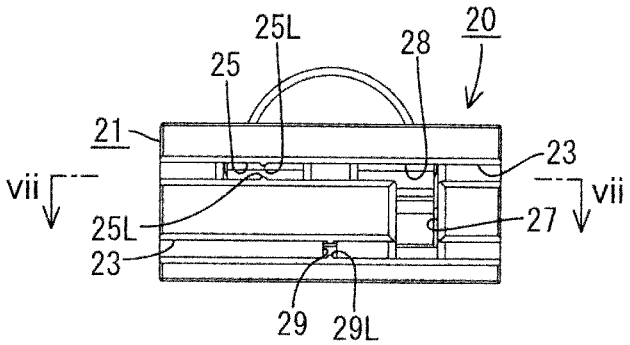
FIG. 5 is a front view of a holder.

As shown in FIG. 8, the busbar holding portion 21 is a rectangular block that is wide in the width direction WD of the holder 20. The busbar holding portion 21 is formed with mounting grooves 23 for receiving the strip-like couplings 43 of the busbars 40, as shown in FIG. 5. The mounting grooves 23 are open forward and are long in the width direction WD, and the strip-like couplings 43 of the busbars 40 can be mounted therein from the front. When the busbar pieces 40 are mounted, the rear end surfaces of the strip-like couplings 43 contact rear surfaces 23A (see FIG. 7) of the mounting grooves 23 and are stopped, as shown in FIG. 8. Further, the mounting grooves 23 are substantially parallel in upper and lower rows in the busbar holding portion 21.

As shown in FIG. 7, the second connecting portion insertion hole 25 penetrates through the back end 23A of the mounting groove 23 in the upper row. The second electronic component connecting portion 45B of the second busbar 40B is inserted into the mounting groove 23 from the front and along the mounting direction MD to project through the second connecting portion insertion hole 25 and into the intermediate portion 31. Note that a width of the second connecting portion insertion hole 25 substantially equals the width of the second electronic component connecting portion 45B. Upper and lower ribs 25L extend in the front-back direction FBD from the front end of the mounting groove 23 to the rear end of the second connecting portion insertion hole 25 and are substantially in a widthwise center of the second connecting portion insertion hole 25. The ribs 25L are squeezed when the second electronic component connecting portion 45B is inserted into the second electronic component insertion hole 25 so that the second electronic component connecting portion 45B is positioned vertically.

As shown in FIG. 5, the busbar holding portion 21 is formed with an insertion hole 27 that allows the mounting grooves 23 in the upper and lower rows to communicate vertically. The first electronic component connecting portion 45A of the first busbar 40A is insertable into the insertion hole 27. The insertion hole 27 is slightly wider than the bent portion 27 of the first electronic component connecting portion 45A. Further, as shown in FIG. 7, a first connecting portion insertion hole 28 penetrates through the back end 23A of the mounting groove 23 in the upper row and can receive the first connection portion 48A of the first electronic component connecting portion 45A. The first connection portion 48A of the first electronic component connecting portion 45A is inserted into the mounting groove 23 in the upper row from the front to project through the first connecting portion insertion hole 28 and into the intermediate portion 31, as shown in FIG. 14. At that time, the bent part is inserted into the insertion hole 27. Note that the first connecting portion insertion hole 28 is wider than the insertion hole 27 and enables insertion of the first connection portion 48A of the first electronic component connecting portion 45A. The first connecting portion insertion hole 28 and the insertion hole 27 communicate to form a through hole for receiving the first electronic component connecting portion 45A. Further, a thin portion 24 is formed between the first and second connecting portion insertion holes 28 and 25 in the upper row, as shown in FIG. 7, where the resin of the busbar holding portion 21 is thinned.

The holder press-fit hole 29 is formed on the back end 23A of the mounting groove 23 in the lower row at a position corresponding to the first press-fit portion 51 of the first busbar 40A, as shown in FIG. 15. The holder press-fit hole 29 is substantially in a widthwise center of the holder 20 and penetrates to the back side of the busbar holding portion 21. As shown in FIG. 5, upper and lower ribs 29L extend in the front-back direction substantially in a center of the mounting groove 23 in the lower row. These ribs 29L extend from the front end of the mounting groove 23 to the rear end of the holder press-fit hole 29.

Figure 2:
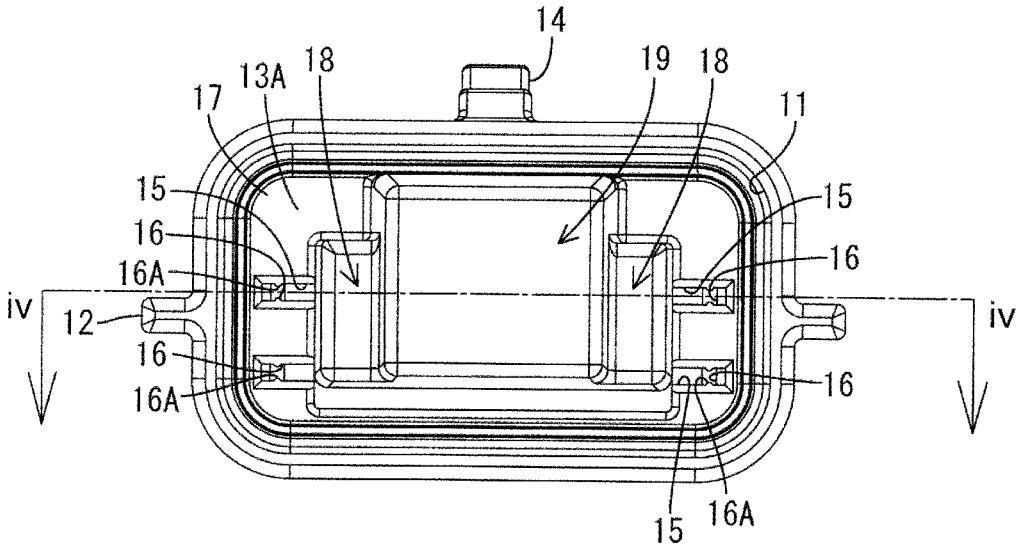
FIG. 2 is a front view of a housing.
Figure 3:
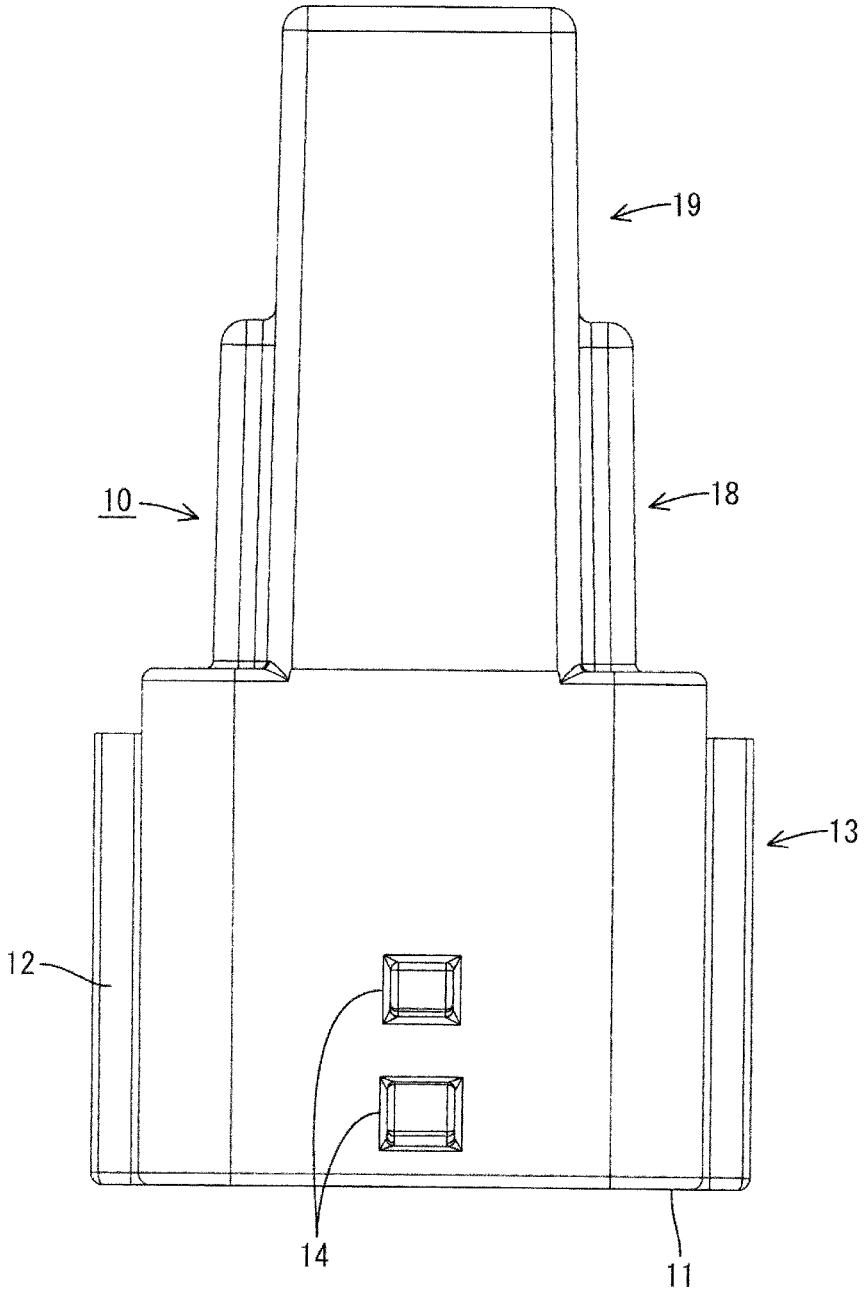
FIG. 3 is a plan view of the housing.

The mating connector 80 is to be fit to the receptacle 13 (see FIG. 14). Ribs 12 are provided on outer side surfaces of the receptacle 13, as shown in FIG. 2, for fitting the receptacle 13 in a proper posture to the mating connector 80, and a lock mechanism 14 is provided on an outer upper part of the receptacle 13 for locking the mating connector 80 in a properly connected state. A seal 81, such as an O-ring, is provided in the mating connector 80, as shown in FIG. 14, and closely contacts the inner surface of the receptacle 13 to achieve a fluid-tight connection. Further, a connection bottom surface 13A of the receptacle 13 faces the front surface of the mating connector 80 at the time of connection.

Figure 4:
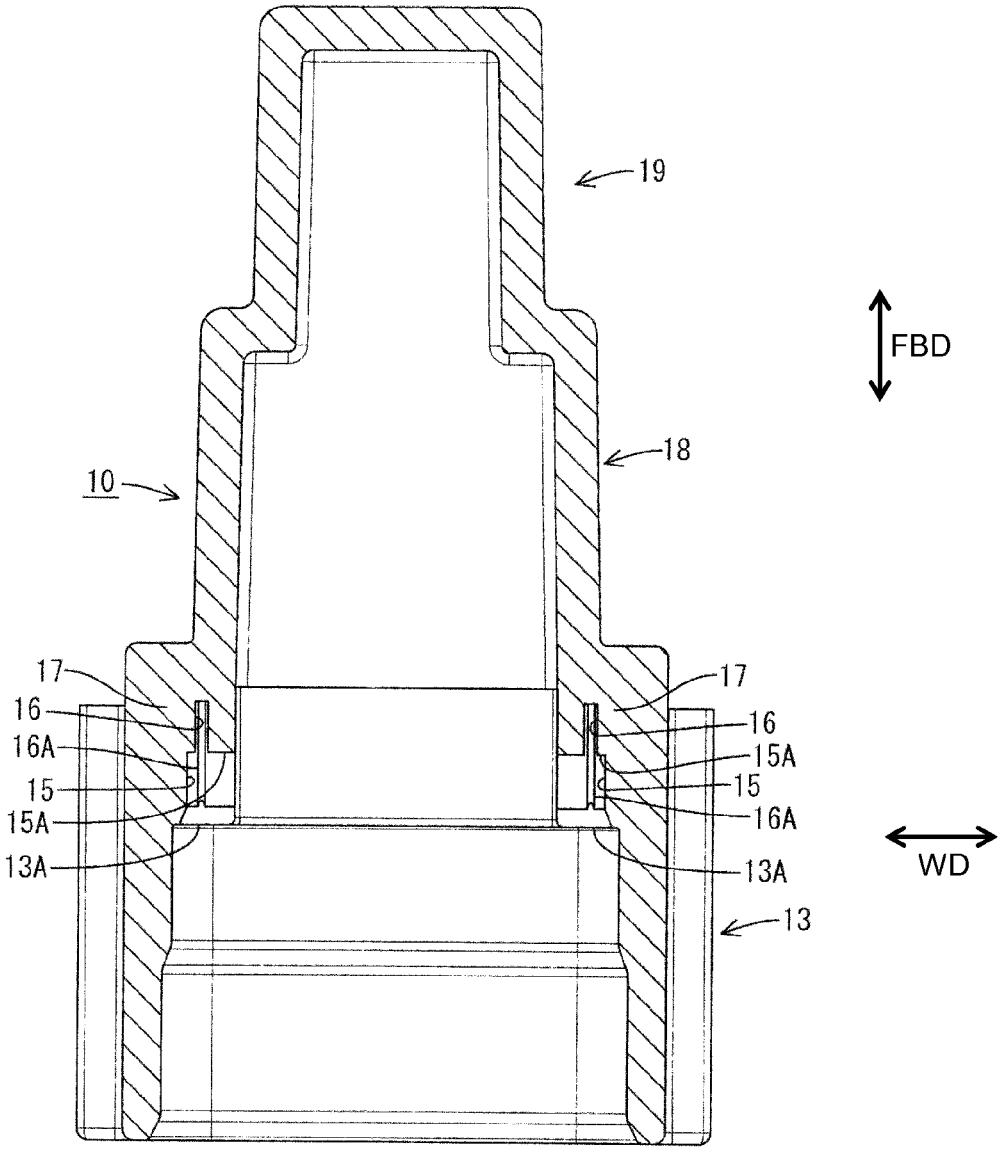
FIG. 4 is a section along iv-iv of FIG. 2.

As shown in FIGS. 2 and 4, the capacitor accommodating portion 19 is retracted back from the connection bottom surface 13A of the receptacle 13. Further, the holder accommodating portion 18 is retracted from the connection bottom surface 13A and has a larger opening than the capacitor accommodating portion 19. A thick portion 17 is formed behind the connection bottom surface 13A of the receptacle 13. The thick portion 17 is formed by elongating a rear end part of the receptacle 13 in a direction toward the holder accommodating portion 18 and overlaps a front part of the holder accommodating portion 18 to couple for the receptacle 13 and the holder accommodating portion 18. Further, the busbar holding portion 21 of the holder 20 is at a position of the holder accommodating portion 18 corresponding to an inner part of the thick portion 17.

As shown in FIG. 2, housing insertion grooves 15 are formed in the thick portion 17 at the left and right sides of the holder accommodating portion 18 and receive opposite end parts of the strip-like couplings 43 of the busbars 40. The insertion grooves 15 are parallel and extend back from the connection bottom surface 13A in upper and lower rows. Further, as shown in FIG. 4, each housing insertion groove 15 of the thick portion 17 is formed with the housing press-fit hole 16 recessed back from a rear surface 15A. Upper and lower ribs 16A extend in the front-back direction FBD in the housing insertion groove 15. The ribs 16A are provided from the front end of the housing insertion groove 15 to the rear end of the housing press-fit hole 16 and position the housing press-fit portion 55. Further, provision of the housing press-fit holes 16 in the thick portion 17 ensure that cracks and the like are not caused even if forces of the housing press-fit portions 55 are applied to the housing press-fit holes 16.

The intermediate portion 31 (see FIG. 5) of the holder 20 can be accommodated into the holder accommodating portion 18 without play.

As shown in FIG. 14, the electronic component holding portion 35 of the holder 20 can be accommodated into the capacitor accommodating portion 19. The capacitor accommodating portion 19 has a length so that a space is provided on the back side of the capacitor accommodating portion 19.

A mounting method is described using FIGS. 1, 8 to 15. First, the first busbar 40A is mounted into the holder 20 and is pushed back in the mounting direction MD with the first electronic component connecting portion 45A in the lead so that the first strip-like coupling 43A is in the mounting groove 23 in the lower row, the bent portion 47 of the first electronic component connecting portion 45A is in the insertion hole 27 and the wide part of the first electronic component connecting portion 45A is in the mounting groove 23 in the upper row before the first connecting portion insertion hole 28. The first press-fit portion 51 then is inserted while being sandwiched between the ribs 29L of the mounting groove 23 in the lower row and, eventually is press-fit into the holder press-fit hole 29. The connection portion 48A of the first electronic component connecting portion 45A then projects into a hollow part of the intermediate portion 31. The pushing of the first busbar piece 43A is stopped when the rear end surface of the first strip-like coupling 43A contacts the back end 23A of the mounting groove 23 in the lower row. Note that when the first electronic component connecting portion 45A is inserted into the insertion hole 27 and the first connecting portion insertion hole 28 is not press-fit and only the first press-fit portion 51 is press-fit. In this way, the first busbar 40A is held in the busbar holding portion 21 by the engagement of the first press-fit portion 51 with the inner peripheral surface of the holder press-fit hole 29.

The second busbar piece 40B then is mounted into the holder 20. The second busbar piece 40B is pushed back in the mounting direction MD with the second electronic component connecting portion 45B in the lead so that the second strip-like coupling 43B is in the mounting groove 23 in the upper row and the second electronic component connecting portion 45B is between the ribs 25L in the second connecting portion insertion hole 25. The second press-fit portions 53 of the second electronic component connecting portion 45B then are press-fit into the second connecting portion insertion hole 25. Then, a tip part of the second electronic component connecting portion 45B projects into the hollow part of the intermediate portion 31. The pushing of the second busbar 43B is stopped when the rear end surface of the second strip-like coupling 43B contacts the back surface of the mounting groove 23 in the upper row. In this way, the engagement of the second press-fit portions 53 with the inner surface of the second connecting portion insertion hole 25 holds the second busbar 40B in the busbar holding portion 21.

When the busbars 40 are mounted into the holder 20 in this way, the press-fit portions 55 and the opposite left and right ends of the strip-like couplings 43 project laterally to the left and right from the busbar holding portion 21.

There are advantages of forming the second press-fit portions 53 on the electronic component connecting portion 45 rather than separately, as with the first press-fit portion 5. More particularly, electronic component connecting portions of the terminals must be bent to adjust the height or position of a connection surface of the electronic component when incorporating an electronic component into a connector that has joint terminals arranged in plural rows. Accordingly, a method has been considered for press-fitting terminal fittings before bending and then bending the press-fit terminal fittings. Terminals are longer before being bent and hence this approach requires a longer connector. Bending the terminals after the terminals have been press-fit also is more difficult than bending the terminals before press-fitting. Japanese Unexamined Patent Publication No. 2013-45536 attempts to address these problems by bending the terminals into predetermined shapes, inserting bent parts from the bottom surface of the connector and then press-fitting portions of the terminals that are separate from the bent parts.

However, this technique adds a production step since the bent parts are inserted from the bottom surface and increases cost due to press-fitting by a special device. Accordingly, inserting the bent parts from the front has been considered. However, this alternative requires a hole for inserting the bent parts. In this embodiment, the thin portion 24 is formed between the first and second connecting portion insertion holes 28, 25. A press-fit hole could be formed in such a thin portion 24. However, forces caused by press-fitting are likely to form cracks in the thin portion 24. This invention avoids forming cracks by press-fitting the second press-fit portions 53 on the second electronic component connecting portion 45 into the already formed second connecting portion insertion hole 25.

The capacitor 60 is mounted after the busbars 40 are mounted. The capacitor 60 is so inserted through the rear opening of the tubular portion 36 so that the respective lead wires 62 contact the electronic component connecting portions 45 from above. The lead wires 62 then are resistance welded respectively to the first and second welding portions 48A and 48B while being sandwiched between upper and lower electrodes of resistance welding apparatus.

The holder 20 mounted with the busbars 40 and the capacitor 60 then is mounted into the housing 10. More particularly, the holder 20 is inserted through the insertion opening 11 with the capacitor 60 in the lead. Ends of strip-like couplings 43 of the busbars 40 project from the holder 20 and are pushed to push the busbars 40 in. The housing press-fit portions 55 of the busbars 40 are press-fit into the housing press-fit holes 16 while being held in contact with the ribs 16A of the housing press-fit holes 16. Pushing is stopped when the rear end surfaces of the ends of the strip-like couplings 43 projecting from the holder 20 contact the rear surfaces 15A of the housing insertion grooves 15. Thus, the holder 20 and the busbars 40 are arranged at specified positions in the housing 10. In this way, the busbars 40 are held in the housing 10 by the bite or engagement of the housing press-fit portions 55 with the inner peripheral surfaces of the housing press-fit holes 16. Further, the housing 10 and the holder 20 are fixed via the busbars 40.

As described above, the first and second press-fit portions 51, 53 of the busbars 40 are press-fit into the holder 20 for holding the capacitor 60. The holder 20 then is inserted into the housing 10, which is open in only one direction. The housing press-fit portions 55 on the busbars 40 are press-fit into the housing 10 when the holder 20 is accommodated at the specified position in the housing 10. The busbars 40 hold the holder 20 and the housing 10 by being press-fit. Hence, the holder 20 is held in the housing 10 via the busbars 40. Using the busbars 40 to hold the holder 20 and the housing 10 avoids the need for another component and the number of components can be reduced. Further, the housing 10 does not need a hole or a projection, and there is no need for a structure to seal the hole in the housing 10 so that the interior of the housing 10 is waterproofed easily.

Each busbar 40 has two housing press-fit portions 55 and the housing press-fit portions 55 are provided at positions to project from the outer surfaces of the holder 20. Accordingly, a holding force can be improved since the busbar piece 40 is fixed to the housing 10 at two points. Further, the housing press-fit portions 55 project from the holder 20. Thus, it is sufficient to push only the front edges of the housing press-fit portions 55 backward and it is not necessary to apply an unnecessary force to the holder 20 when the holder 20 and the busbars 40 are inserted into the housing 10 and the housing press-fit portions 55 are press-fit into the housing 10. Specifically, a press-fit force can be applied to the metal busbar 40 and cracks are not formed in the resin of the holder 20.

The housing press-fit portions 55 are press-fit into the thick portion 17 of the housing 10. A force or the like tends to be applied to the positions where the housing press-fit portions 55 are press-fit. In this embodiment, the housing is thickened at the press-fit positions. Therefore breaks, cracks and the like are not likely to form.

The first and second press-fit portions 51, 53 project substantially from the centers of the busbars 40. Thus, if the finished sizes of the busbars 40 and the holder 20 vary within tolerances, the influence of displacements caused by such variation ranges on positioning in press-fitting the housing press-fit portions 55 can be reduced.

The busbars 40 comprise the first and second busbars 40A, 40B that are insertable substantially in parallel into the holder 20 in the upper and lower rows. Each busbar 40A, 40B has plural terminal portions 41 to be connected to the mating terminal fittings, particularly the strip-like coupling 43 that couples the terminal portions 41 and the electronic component connecting portion 45 to be connected to the capacitor 60. The first electronic component connecting portion 45A includes the bent portion 47 bent into the specified shape and the first welding portion 48A projecting from the holder 20 (busbar holding portion 21) and to be electrically connected to the lead wire 62 of the capacitor 60, and the second electronic component connecting portion 45B of the second busbar piece 40B includes the second welding portion 48B located on the same plane as the coupling projecting from the holder and to be electrically connected to the electronic component, wherein the heights of the first and second welding portions 48A, 48B being substantially aligned.

Insertion into the housing 10 is improved, since the busbars 40 are inserted into the housing 10 after being held in the holder 20. Efficiency also is improved by having the capacitor 60 and the busbars 40 held by the holder 20 when the capacitor 60 and the busbar pieces 40 are welded. Furthermore, one of the electronic component connecting portions 45 includes the bent portion 47 and the other maintains its vertical height. Thus, heights of the electronic component connecting portions 45 are aligned, and the electronic component connecting portions 45 are connected to the capacitor 60 more easily.

The holder 20 has the mounting grooves 23 that receive the first and second busbars 40A, 40B. The first press-fit portion 51 of the first busbar 40A projects from the center of the first strip-like coupling 43A in a direction opposite the terminal portions 41 and is press-fit into the holder press-fit hole 29 formed in the back end 23A of the mounting groove 23. With this configuration, the first busbar 40A including the bent portion 47 is fixed by press-fitting the first press-fit portion 51 into the holder 20. The first press-fit portion 51 is separate from the first electronic component connecting portion 45A including the bent portion 47. Thus, press-fitting does not apply a load to the vicinity of the bent portion 47. Further, the first press-fit portion 51 is in the center of the strip-like coupling 43, and therefore the influence of displacements caused by tolerances can be reduced.

The holder 20 includes the mounting grooves 23 that receive the first and second busbars 40A, 40B. The first connecting portion insertion hole 28 and insertion hole 27 that receive the bent portion 47 and the first connection portion 48A and the second connecting portion insertion hole 25 that receives the second electronic component connecting portion 45B are formed adjacent to each other. The part between the through hole and the second connecting portion insertion hole 25 is thin. The second electronic component connecting portion 45B includes the second press-fit portions 53 to be press-fit into the second connecting portion insertion hole 25. With this configuration, a relatively large through hole (first connecting portion insertion hole 28 and insertion hole 27) is formed to insert the bent portion 47 and the first connection portion 48A of the first busbar 40A. A part between this through hole and the second connecting portion insertion hole 35 is thin. Thus, it is difficult to provide a holder press-fit portion shaped like the first press-fit portion 51 of the first busbar piece 40A and provide a hole in the thin portion 24 between the through hole and the second connecting portion insertion hole 25. Accordingly, the second press-fit portions 53 are provided on the second electronic component connecting portion 45B and press-fitted into the second connecting portion insertion hole 25. Thus, the second busbar 40B can be press-fit and fixed without enlarging the holder 20. Further, the absence of a hole in the thin portion 24 makes molding easier.

The holder 20 includes the first and second busbars 40A and 40B arranged parallel to one another in the busbar holding portion 21. The first busbar 40A has the first electronic component connecting portion 45A. The first electronic component connecting portion 45A has the bent portion 47 and the first connection portion 48A projecting from the busbar holding portion 21. The second busbar 40B has the flat second electronic component connecting portion 45B projecting from the busbar holding portion 21 and the second connection portion 48B is formed on the second electronic component connecting portion 45B. The through hole 27, 28 in the busbar holding portion 21 that receives the bent portion 47 and the first connection portion 48 is adjacent to the second connecting portion insertion hole 25 that receives the second electronic component connecting portion 45B. The thin part 24 between the through hole 27, 28 and the second connecting portion insertion hole 25 is made very small to meet consumer demands for miniaturization. It would be difficult to provide a hole in the thin portion 24 for receiving a holder press-fit portion shaped like the first press-fit portion 51 of the first busbar 40A. Accordingly, the second press-fit portions 53 are provided on the second electronic component connecting portion 45B and are press-fit into the second connecting portion insertion hole 25 so that the second busbar piece 40B. This configuration enables the second busbar piece 40B to be fixed without enlarging the holder 20. Further, the absence of a hole in the thin portion 24 makes molding easier.

The second press-fit portions 53 are provided on opposite sides of the second electronic component connecting portion 45B. Thus, a press-fit force is applied uniformly to the second electronic component connecting portion 45B.

Each of the first and second busbars 40A, 40B has plural terminals 41 to be connected to the mating terminal fittings and the strip-like coupling 43 couples the terminal portions 41. The first and second electronic component connecting portions 45A, 45B project from the side of the coupling 43 opposite to the terminals 41 and are connected to the capacitor 60 (electronic component). The busbar holding portion 21 has the mounting grooves 23 in upper and lower rows for receiving the strip-like couplings 43. The second connecting portion insertion hole 25 is formed in the back end 23A of the upper mounting groove 23 and receives the second electronic component connecting portion 45B as the first strip-like coupling 43A of the first busbar 40A is inserted into the upper mounting groove 23. The insertion hole 27 is formed from the lower mounting groove 23 that receives the strip-like coupling 43 of the first busbar 40A. The capacitor 60 is held in the holder 20. This configuration holds the first and second busbars 40A, 40B in the holder 20 to facilitate welding the busbars 40 to the capacitor 60. Further, the first and second connection portions 48A, 48B are coplanar to facilitate welding the first and second connection portions 48A, 48B to the lead wires 62 of the capacitor 60.

The invention is not limited to the above described embodiment. For example, the following embodiments are also included in the scope of the invention.

The lead wires 62 of the capacitor 60 need not be round pins and may be rectangular, quadratic or polygonal columns or the like.

The electronic component need not be the capacitor 60 and may be one of various electronic components such as resistors, diodes and transistors.

The busbars 40 are held in the holder 20 in the above embodiment. However, only the press-fit portions may be held and the conductive members may not be held.

Each busbar 40 has plural terminals 41 in the above embodiment. However, others can also be used. For example, one terminal may include a housing press-fit portion and a holder press-fit portion or the coupling may have a columnar shape instead of the strip shape.

The holder press-fit portion projection 51 is provided only on the first strip-like coupling 43A in the above embodiment, but also be provided on the second strip-like coupling 43B. Further, the first press-fit portion 51 is provided substantially near the center of the strip-like coupling 43, but may be provided at another position.

Each housing press-fit portion is a projection having a rounded triangular tip in the above embodiment, but it may have another shape can be held by being press-fit or by some method other than press-fitting into a press-fit hole.

The holder press-fit hole 29 need not be a through hole.

The mating connector 80 has the seal 81 in the above embodiment, but the seal may be omitted. Further, a seal other than an O-ring may be used, such as a rubber plug.

The connector C may be a male connector or a female connector.

The invention also relates to the holder without the housing 10 or to a connector in which a holder and a housing are formed integrally.

The invention can be provided without the capacitor 60 or other electronic component.

Three or more busbars may be provided.

What is claimed is:

1. A connector, comprising:

at least one electronic component;

a holder for holding the electronic component;

a housing including only one insertion opening, the insertion opening being configured to permit insertion of the holder and the electronic component held in the holder through the insertion opening and into the housing; and at least one conductive member for conductively connecting the electronic component and a mating terminal fitting of a mating connector, the conductive member including at least one holder press-fit portion to be press-fit into the holder and at least one housing press-fit portion to be press-fit into the housing so that the holder is held in the housing by the conductive member.

2. The connector of claim 1, wherein the at least one housing press-fit portion is one of two housing press-fit portions provided on the conductive member and projecting laterally from outer surfaces of the holder.

3. The connector of claim 2, wherein the housing includes a thick portion into which the housing press-fit portion is press-fit.

4. The connector of claim 2, wherein the holder press-fit portion is a projection projecting substantially from a center of the conductive member.

5. The connector of claim 2, wherein the at least one conductive member is one of two conductive members that includes a first conductive member and a second conductive member that are insertable substantially in parallel into the holder in first and second rows;

each of the first and second conductive members includes terminals to be connected to the mating terminal fittings, a coupling that couples the terminals and an electronic component connecting portion to be connected to the electronic component;

the electronic component connecting portion of the first conductive member includes a bent portion and a first connection portion projecting from the holder and connected to the electronic component;

the electronic component connecting portion of the second conductive member includes a second connection portion located on a common plane as the coupling, projecting from the holder and connected to the electronic component; and heights of the first and second connection portions being substantially aligned.

6. The connector of claim 5, wherein:

the holder includes at least one insertion portion into which the first and second conductive members are inserted; and the holder press-fit portion of the first conductive member projects from a center of the coupling and substantially parallel to the electronic component connecting portion at a side opposite to the terminals and press-fit into a holder press-fit hole formed in a back end portion of the insertion portion.

7. The connector of claim 6, wherein:

the holder includes an insertion portion into which the first and second conductive members are inserted and a through hole into which the bent portion and the first connection portion are insertable and an insertion hole into which the electronic component connecting portion of the second conductive member is insertable, the through hole and the insertion hole being adjacent to each other in a width direction in the holder;

a part between the through hole and the insertion hole being thin; and the electronic component connecting portion of the second conductive member includes the holder press-fit portion press-fit into the insertion hole.

8. A holder, comprising:

a first conductive member;

a second conductive member substantially parallel to the first conductive member; and a conductive member holding portion for holding the first and second conductive members, wherein:

the first conductive member includes a first connecting portion including a bent portion and a first projecting portion projecting from the conductive member holding portion;

the second conductive member includes a second connecting portion including a substantially flat second projecting portion held in the conductive member holding portion while projecting therefrom;

heights of the first and second projecting portions being substantially aligned;

a through hole in the conductive member holding portion, and the bent portion and the first projecting portion being inserted in the through hole;

an insertion hole in the conductive member holding portion adjacent the through hole and having the second connecting portion inserted in the insertion hole;

a part between the through hole and the insertion hole is thin; and the second connecting portion includes a holder press-fit portion press-fit into the insertion hole.

9. The holder of claim 8, wherein the holder press-fit portion is provided on each of substantially opposite sides of the second connecting portion.

10. The holder of claim 8, wherein:

each of the first and second conductive members includes a plurality of terminals to be connected to mating terminal fittings and a coupling that couples the terminals, and each of the first and second connecting portions is formed on the coupling at a side substantially opposite to the terminals and connected to an electronic component;

the conductive member holding portion includes an insertion portion into which the couplings are insertable substantially in parallel in upper and lower rows;

the insertion hole into which the second connecting portion is insertable is formed in a back end portion of a second insertion hole into which the coupling of the second conductive member is insertable;

the through hole extends from a first insertion hole, into which the coupling portion of the first conductive member is insertable, to the second insertion hole; and the electronic component is held.

* * * * *